US007997239B2

(12) United States Patent
Ishizaka et al.

(10) Patent No.: US 7,997,239 B2
(45) **Date of Patent: *Aug. 16, 2011**

(54) BREATHER DEVICE OF VERTICAL TYPE ENGINE

(75) Inventors: Kazuhiro Ishizaka, Wako (JP); Atsumu Naoi, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 643 days.

This patent is subject to a terminal disclaimer.

(21) Appl. No.: 12/056,891

(22) Filed: Mar. 27, 2008

(65) Prior Publication Data

US 2008/0257319 A1 Oct. 23, 2008

(30) Foreign Application Priority Data

Mar. 30, 2007 (JP) ..... 2007-091755

(51) Int. Cl.
*F01M 13/00* (2006.01)

(52) U.S. Cl. ..... 123/41.86; 123/195 HC

(58) Field of Classification Search ..... 123/572–574, 123/41.86, 195 HC, 196 W
See application file for complete search history.

(56) References Cited

U.S. PATENT DOCUMENTS

| | | | | |
|---|---|---|---|---|
| 4,958,613 | A * | 9/1990 | Hiraoka et al. | 123/572 |
| 5,514,015 | A * | 5/1996 | Okazawa et al. | 440/88 L |
| 6,334,438 | B1 * | 1/2002 | Itoh et al. | 123/572 |
| 6,516,768 | B1 * | 2/2003 | Watanabe | 123/184.36 |
| 6,827,068 | B1 * | 12/2004 | Sakata et al. | 123/572 |
| 7,704,174 | B2 * | 4/2010 | Takada et al. | 474/144 |
| 2002/0017283 | A1 * | 2/2002 | Furuya | 123/573 |
| 2004/0149242 | A1 * | 8/2004 | Hori et al. | 123/41.86 |
| 2008/0245321 | A1 * | 10/2008 | Ishizaka et al. | 123/41.86 |

FOREIGN PATENT DOCUMENTS

| | | | |
|---|---|---|---|
| JP | 63-243415 | A | 10/1988 |
| JP | 03-000914 | A | 1/1991 |
| JP | 9-41937 | A | 2/1997 |
| JP | 09-041986 | A | 2/1997 |
| JP | 11-200831 | A | 7/1999 |

* cited by examiner

*Primary Examiner* — Marguerite J. McMahon
(74) *Attorney, Agent, or Firm* — Arent Fox LLP

(57) ABSTRACT

A breather device of a vertical type engine includes: an engine body having a crank chamber and a cylinder bore; and a timing transmission chamber provided above the engine body and housing a timing transmission device that connects between a crankshaft and a cam shaft which are vertically placed, respectively, the timing transmission chamber communicating at one side with the crank chamber and at the other side with the outside, wherein the breather device includes a breather chamber communicating with the timing transmission chamber via a communication tube, the breather chamber communicating with an intake silencer box. Hence, oil can be efficiently separated from breathing gas of a crank chamber.

4 Claims, 9 Drawing Sheets

BREATHER DEVICE OF VERTICAL TYPE ENGINE

CROSS-REFERENCE TO RELATED APPLICATION

This application claims the priority of JP Application No. 2007-91755, filed Mar. 30, 2007, the entire specification, claims and drawings of which are incorporated herewith by reference.

BACKGROUND OF THE INVENTION

1. Field of the Invention

The present invention relates to a breather device of a vertical type engine comprising: an engine body having a crank chamber and a cylinder bore; a timing transmission chamber provided above the engine body and housing a timing transmission device that connects between a crankshaft and a cam shaft which are vertically placed, respectively, the timing transmission chamber communicating at one side with the crank chamber and at the other side with an outside.

2. Description of the Related Art

A breather device of a vertical type engine has been known as disclosed in Japanese Patent Application Laid-open No. 9-41937.

In a timing transmission chamber, though an amount of lubricant oil dispersed therein is smaller than that in a crank chamber, an operation of a timing transmission device causes dispersion of lubricant oil, which makes effective gas-liquid separation difficult. Thus, if a breather pipe communicating with the outside is simply connected to the timing transmission chamber, a considerable amount of oil droplets may be discharged to the outside together with a blow-by gas.

SUMMARY OF THE INVENTION

The present invention is achieved in view of this point, and has an object to provide a breather device of a vertical type engine that uses a timing transmission chamber as a pre-breather chamber so that oil can be efficiently separated from breathing gas in a crank chamber.

In order to achieve the above-mentioned object, according to a first feature of the present invention, there is provided that a breather device of a vertical type engine comprising: an engine body having a crank chamber and a cylinder bore; a timing transmission chamber provided above the engine body and housing a timing transmission device that connects between a crankshaft and a cam shaft which are vertically placed, respectively, the timing transmission chamber communicating at one side with the crank chamber and at the other side with an outside, wherein the breather device comprises a breather chamber communicating with the timing transmission chamber via a communication passage, the breather chamber communicating with the outside.

With the first feature, breathing gas in the crank chamber is exhausted to the timing transmission chamber and decompressed, and then exhausted to the breather chamber via the communication passage and decompressed. Thus, the timing transmission chamber functions as a pre-breather chamber, and oil from the breathing gas in the crank chamber can be generally and efficiently decompressed and separated.

Further, the timing transmission chamber and the breather chamber are connected via the communication passage. Thus, placement flexibility of the breather chamber is high. Further, oil mist is cooled by the communication passage when passing through the communication passage, returns to the timing transmission chamber or moves to the breather chamber in a liquefied state, and is not discharged to the outside, thereby facilitating gas-liquid separation.

According to a second feature of the present invention, in addition to the first feature, the timing transmission chamber and the breather chamber are defined between the engine body that supports the crankshaft and the cam shaft, and a cover member joined to the engine body so as to cover an upper surface of the engine body; and a bulkhead between the timing transmission chamber and the breather chamber is formed integrally with one or both of the engine body and the cover member.

With the second feature, by simply joining the cover member to the upper surface of the engine body, the timing transmission chamber and the breather chamber can be easily formed between the cover member and the engine body, thereby simplifying a structure and increasing assembling properties.

According to a third feature of the present invention, in addition to the first feature, an opening of the communication passage into the timing transmission chamber is placed in an area other than an operation area of the timing transmission device.

With the third feature, droplets of lubricant oil dispersed from the timing transmission device in the timing transmission chamber are prevented as much as possible from entering the communication passage.

According to a fourth feature of the present invention, in addition to the first feature, the communication passage is comprised of a flexible communication tube.

With the fourth feature, the communication tube has flexibility, and thus can be freely placed without choosing a position of the breather chamber, thereby further increasing placement flexibility of the breather chamber, and allowing a communication between the timing transmission chamber and the breather chamber easily and inexpensively.

The above-mentioned object, other objects, characteristics, and advantages of the present invention will become apparent from an explanation of a preferred embodiment, which will be described in detail below by reference to the attached drawings.

DESCRIPTION OF THE PREFERRED EMBODIMENT

Now, a preferred embodiment of the present invention will be described with reference to the drawings.

In the following description, the terms "front", "rear", "right" and "left" are used with reference to a boat B to which the outboard engine system O is mounted.

Figure 1:
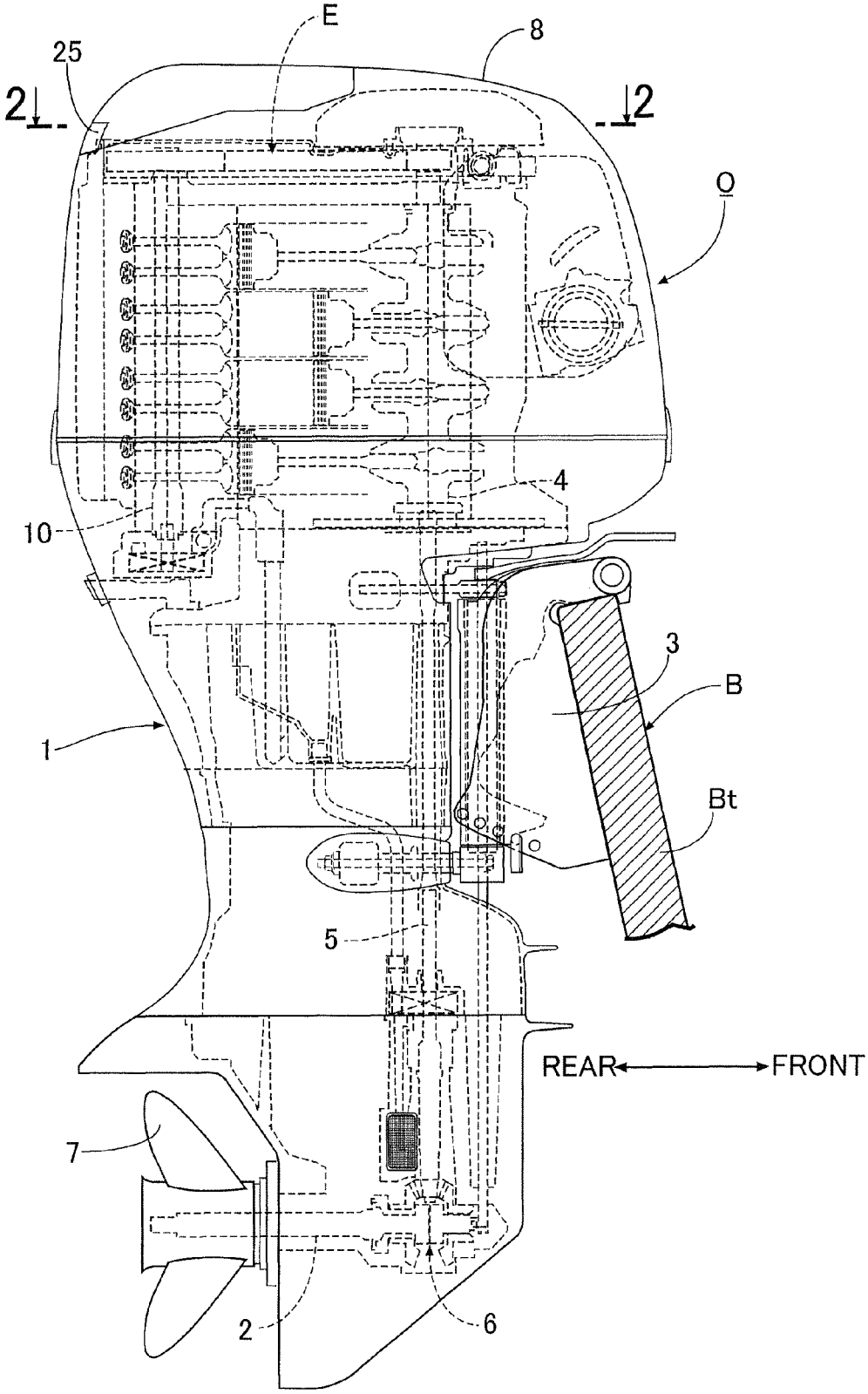
FIG. 1 is a side view of an outboard engine system including an engine according to the present invention.

First in FIG. 1, the outboard engine system O includes a vertically long casing 1, a vertical type multi-cylinder engine E mounted on an upper end of the casing 1, a propeller shaft 2 supported by a lower end portion of the casing 1, and a stern bracket 3 provided in a front portion of the casing 1 and which is removably mounted to a transom Bt of the boat B. In the casing 1, a drive shaft 5 connected to a crankshaft 4 of the engine E, and a forward/rearward movement switching mechanism 6 connecting a lower end portion of the drive shaft 5 to the propeller shaft 2 are provided, and a propeller 7 is mounted to a rear end of the propeller shaft 2. To the upper end of the casing 1, an engine cover 8 that covers the engine E is removably mounted.

Figure 2:
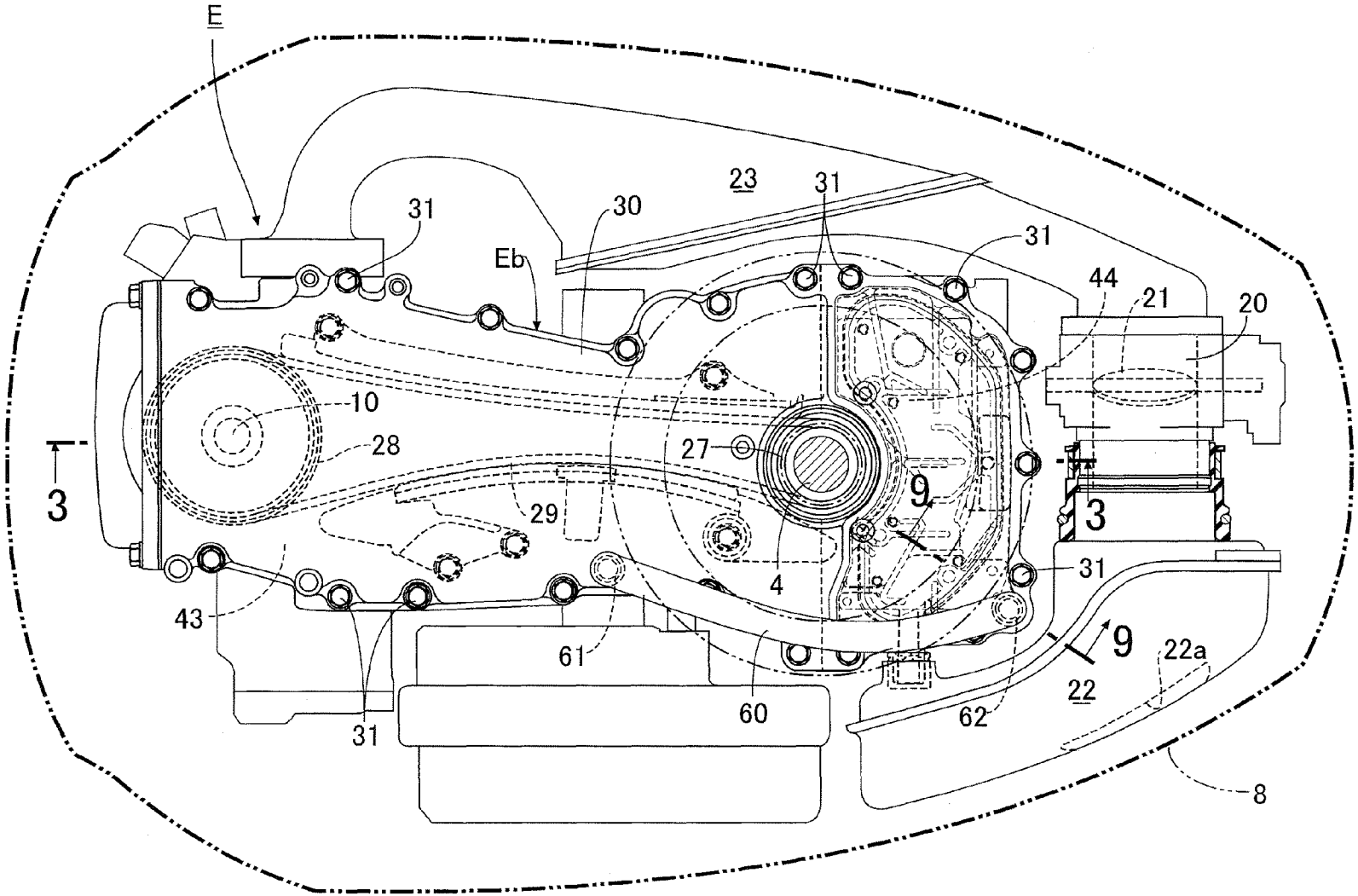
FIG. 2 is a view taken along the arrow direction of the line 2-2 in FIG. 1.
Figure 3:
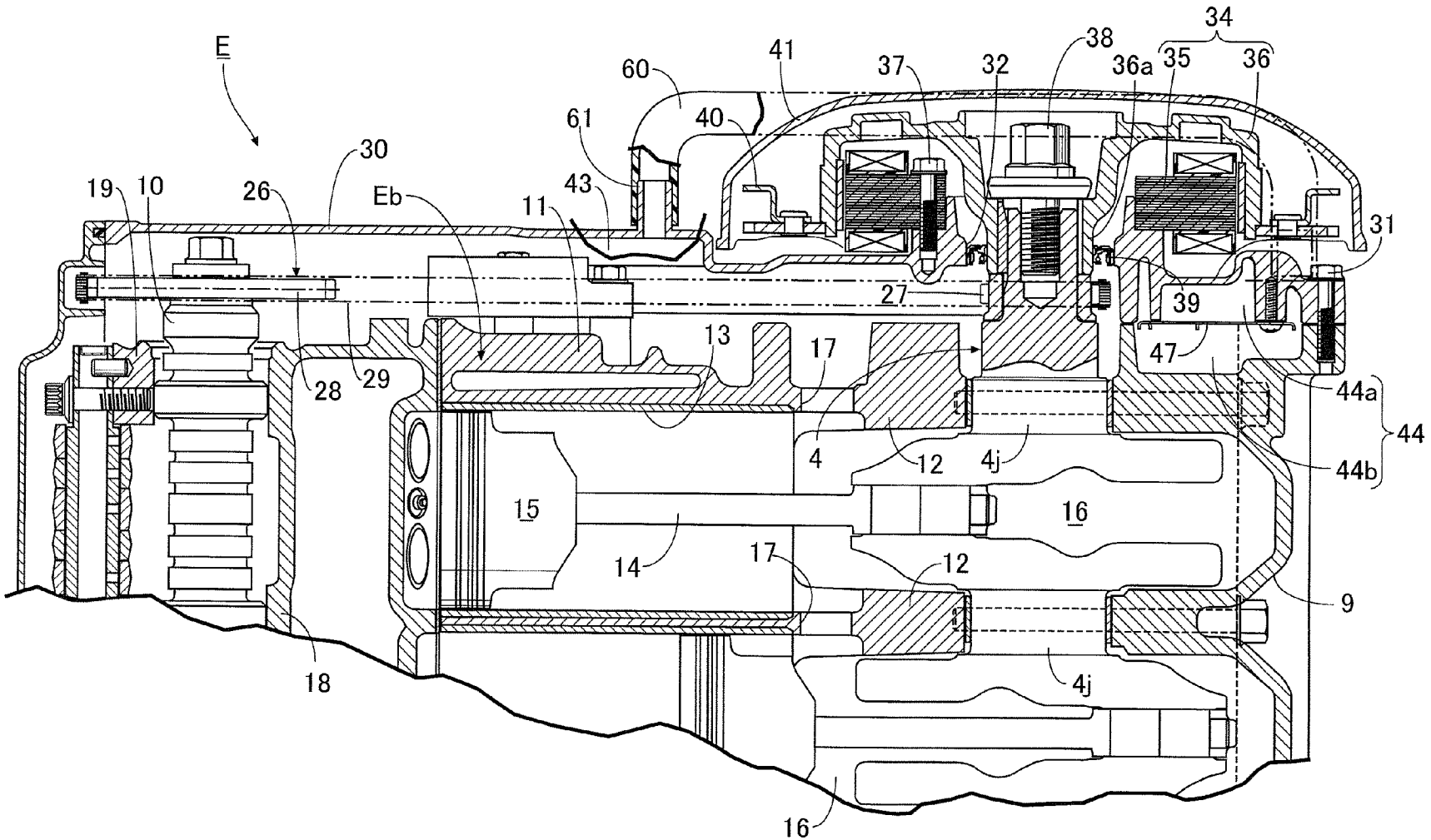
FIG. 3 is a sectional view taken along the line 3-3 in FIG. 2.
Figure 4:
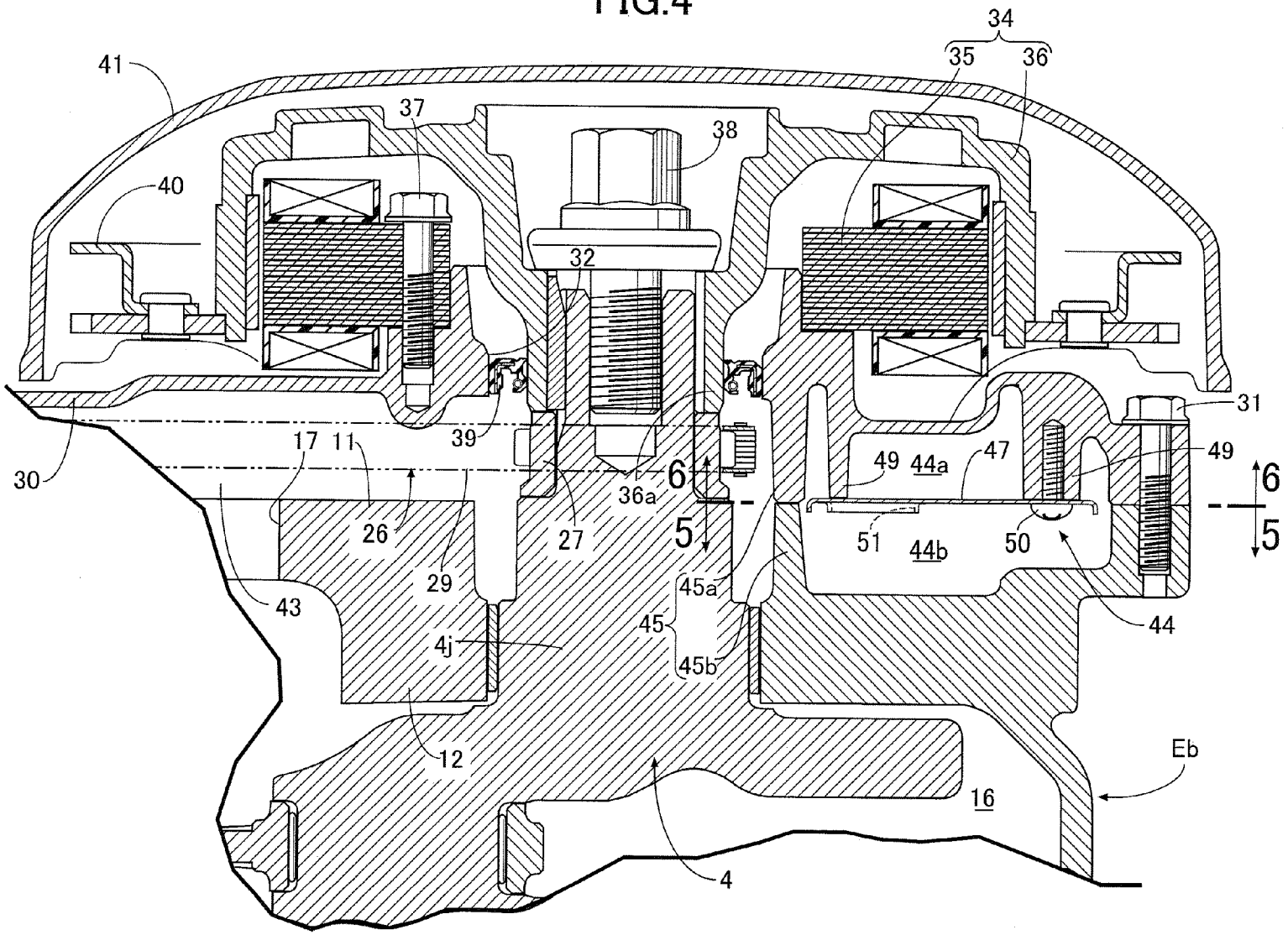
FIG. 4 is an enlarged view of essential portions in FIG. 3.

As shown in FIGS. 2 and 3, the engine E includes the vertically placed crankshaft 4, and a cam shaft 10 placed behind and in parallel with the crankshaft 4.

A plurality of journals 4*j* of the crankshaft 4 are rotatably supported by a plurality of journal support walls 12 formed at joints between a crank case 9 and a cylinder block 11 placed behind the crank case 9. A plurality of vertically arranged cylinder bores 13 are formed in the cylinder block 11, and a piston 15 connected to the crankshaft 4 via a connecting rod 14 is fitted in each cylinder bore 13. Between the crank case 9 and the cylinder block 11, a plurality of crank chambers 16 partitioned by the plurality of journal support walls 12 are defined, and the crank chambers 16 communicate with each other via through holes 17 provided in the journal support walls 12.

The cam shaft 10 is rotatably supported by a cylinder head 18 joined to a rear end surface of the cylinder block 11, and a cam holder 19 joined to the cylinder head 18. The cam shaft 10 is a valve operating cam shaft for opening and closing an intake valve and an exhaust valve corresponding to each cylinder bore 13 due to a rotation of the cam shaft 10.

The crank case 9, the cylinder block 11 and the cylinder head 18 comprise an engine body Eb, a throttle body 20 (see FIG. 2) is provided adjacent to a front surface of the engine body Eb, an intake silencer box 22 connected to an upstream end of the throttle body 20 is provided adjacent to a front right side of the engine body Eb, and an intake manifold 23 that connects a downstream end of the throttle body 20 to an intake port of the cylinder head 18 is provided adjacent to a left side of the engine body Eb. Thus, during operation of the engine E, air flowing into the engine cover 8 through an air inlet 25 in an upper portion of the engine cover 8 flows into the intake silencer box 22 through an intake port 22*a* of the intake silencer box 22, then moves into the throttle body 20, is regulated in flow rate by a throttle valve 21, and then distributed to each cylinder bore 13 through the intake manifold 23.

Upper ends of the crankshaft 4 and the cam shaft 10 protrude upward of the engine body Eb, and the upper ends are connected to each other via a timing transmission device 26. The timing transmission device 26 includes a driven sprocket 27 secured to the upper end portion of the crankshaft 4, a follow sprocket 28 secured to the upper end portion of the cam shaft 10 and having a larger diameter than that of the driven sprocket 27, and a timing chain 29 extending between the sprockets 27 and 28, and transmits rotation of the crankshaft 4 with speed reduced to the half.

To the engine body Eb, a cover member 30 that covers an upper surface of the engine body Eb together with the timing transmission device 26 is joined by a plurality of bolts 31 arranged along a peripheral edge of the cover member 30. The upper end portion of the crankshaft 4 passes through a through hole 32 in the cover member 30 and further protrudes upward, and a generator 34 is mounted between the upper end portion of the crankshaft 4 and the cover member 30. Specifically, an annular stator 35 placed to surround the through hole 32 is secured to an upper surface of the cover member 30 by a bolt 37, and a hub 36*a* of a cylindrical outer rotor 36 surrounding the stator 35 is spline-fitted to the upper end portion of the crankshaft 4 and secured by a bolt 38. The hub 36*a* is placed so as to pass through the through hole 32, and an oil seal 39 in tight contact with an outer peripheral surface of the hub 36*a* is fitted to the through hole 32. A pulley 40 around which an emergency starter rope is wound is secured to an outer periphery of the outer rotor 36. The generator 34 is generally covered with a removable generator cover 41.

The cover member 30 defines, between itself and the upper surface of the engine body Eb, a timing transmission chamber 43 housing the timing transmission device 26, and a breather chamber 44 placed on the side opposite from the cam shaft 10 with respect to the crankshaft 4, at a position adjacent to the timing transmission chamber 43 and below the generator 34.

In this case, a bulkhead 45 between the timing transmission chamber 43 and the breather chamber 44 is formed integrally with one or both of the engine body Eb and the cover member 30 as shown in FIGS. 4 to 7. The shown embodiment takes the latter structure. Specifically, the bulkhead 45 is comprised of a lower bulkhead 45*b* integrally protruding on an upper surface of the crank case 9 so as to be as close as possible to a joint surface between the crank case 9 and the cylinder block 11, and an upper bulkhead 45*a* integrally protruding on a lower surface of the cover member 30 so that a lower end of the upper bulkhead 45*a* abuts against an upper end of the lower bulkhead 45*b*.

The timing transmission chamber 43 communicates with an uppermost crank chamber 16 via the through hole 17 in an uppermost journal support wall 12.

Figure 9:
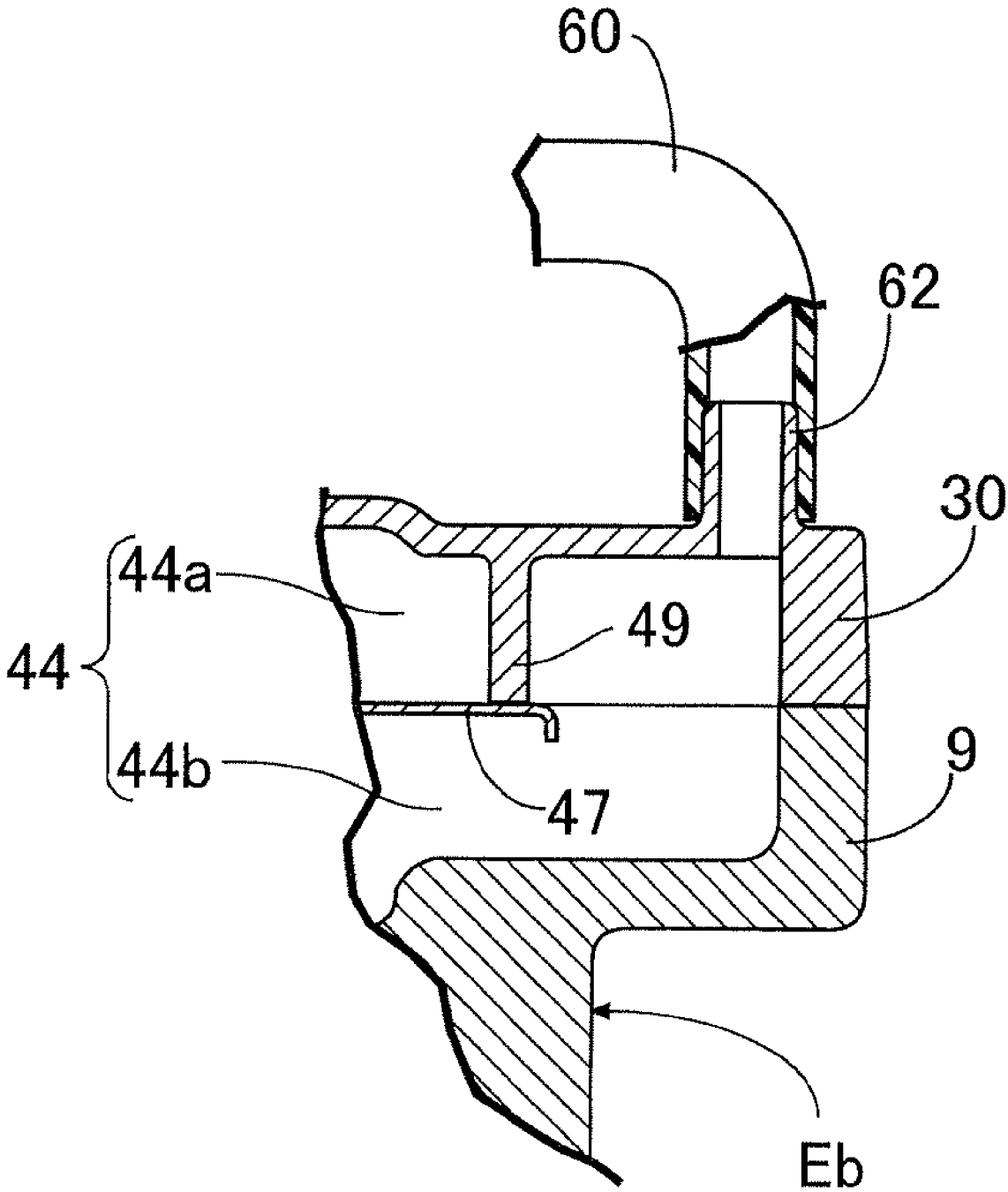
FIG. 9 is a sectional view taken along the line 9-9 in FIG. 2.

The breather chamber 44 is partitioned into an upper breather chamber 44*a* and a lower breather chamber 44*b* placed below the upper breather chamber 44*a* by a partition plate 47, and as shown in FIGS. 2, 3 and 9, the lower breather chamber 44*b* communicates with the transmission chamber 43 via a flexible communication tube 60. Specifically, a first connecting pipe 61 opening into the timing transmission chamber 43 on the outside of a travel path of the timing chain 29, and a second connecting pipe 62 opening into the lower breather chamber 44*b* are integrally formed with the cover member 30, and the connecting pipes 61 and 62 are connected to each other via the communication tube 60.

Returning to FIGS. 4 to 7, the upper breather chamber 44*a* is defined by an endless surrounding wall 49 integrally protruding on a lower surface of the cover member 30 so as to be as close as possible to an inner peripheral surface of the breather chamber 44, and the partition plate 47 joined to a lower end surface of the surrounding wall 49 by a plurality of screws 50. The partition plate 47 has a communication hole 51 that provides communication between the upper and lower breather chambers 44*a* and 44*b*. The upper breather chamber 44*a* communicates with a breather outlet pipe 52 integrally formed with the cover member 30 on the side opposite from the communication hole 51. To an outer end portion of the breather outlet pipe 52 protruding from an outer side surface of the cover member 30, a connecting pipe 53 integrally formed with a side wall of the intake silencer box 22 and communicating with the intake silencer box 22 is fitted via a seal member 54.

Figure 5:
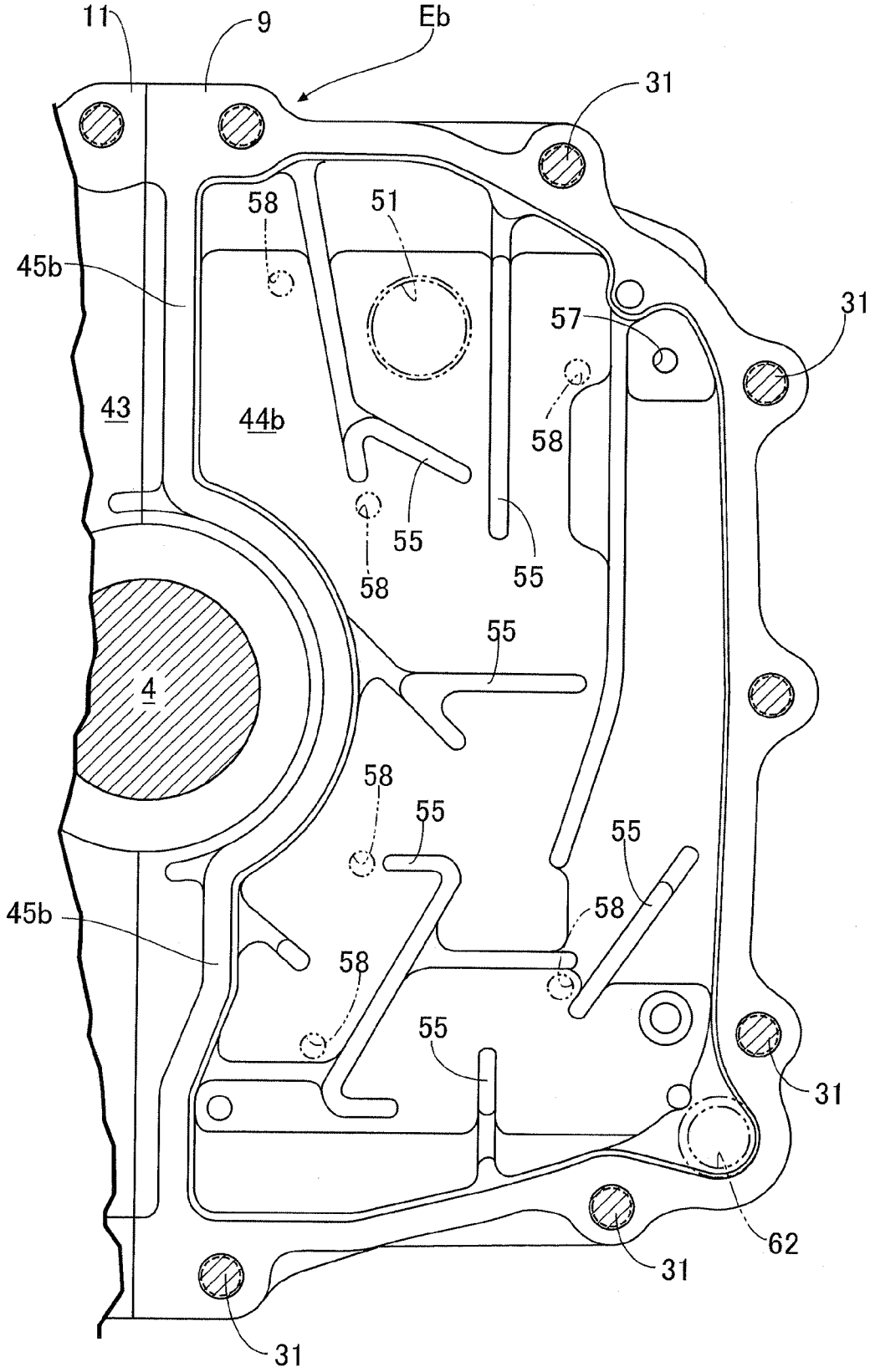
FIG. 5 is a sectional view taken along the line 5-5 in FIG. 4.

As clearly shown in FIG. 5, in the lower breather chamber 44*b*, a plurality of lower labyrinth walls 55 are arranged to form channels extending from the second connecting pipe 61 to the communication hole 51 in a labyrinth manner, and the lower labyrinth walls 55 are integrally formed with the crank case 9. Also in the upper breather chamber 44*a*, a plurality of upper labyrinth walls 56 are arranged to form channels extending from the communication hole 51 to the breather outlet pipe 52 in a labyrinth manner, and the upper labyrinth walls 56 are integrally formed with the cover member 30.

Figure 6:
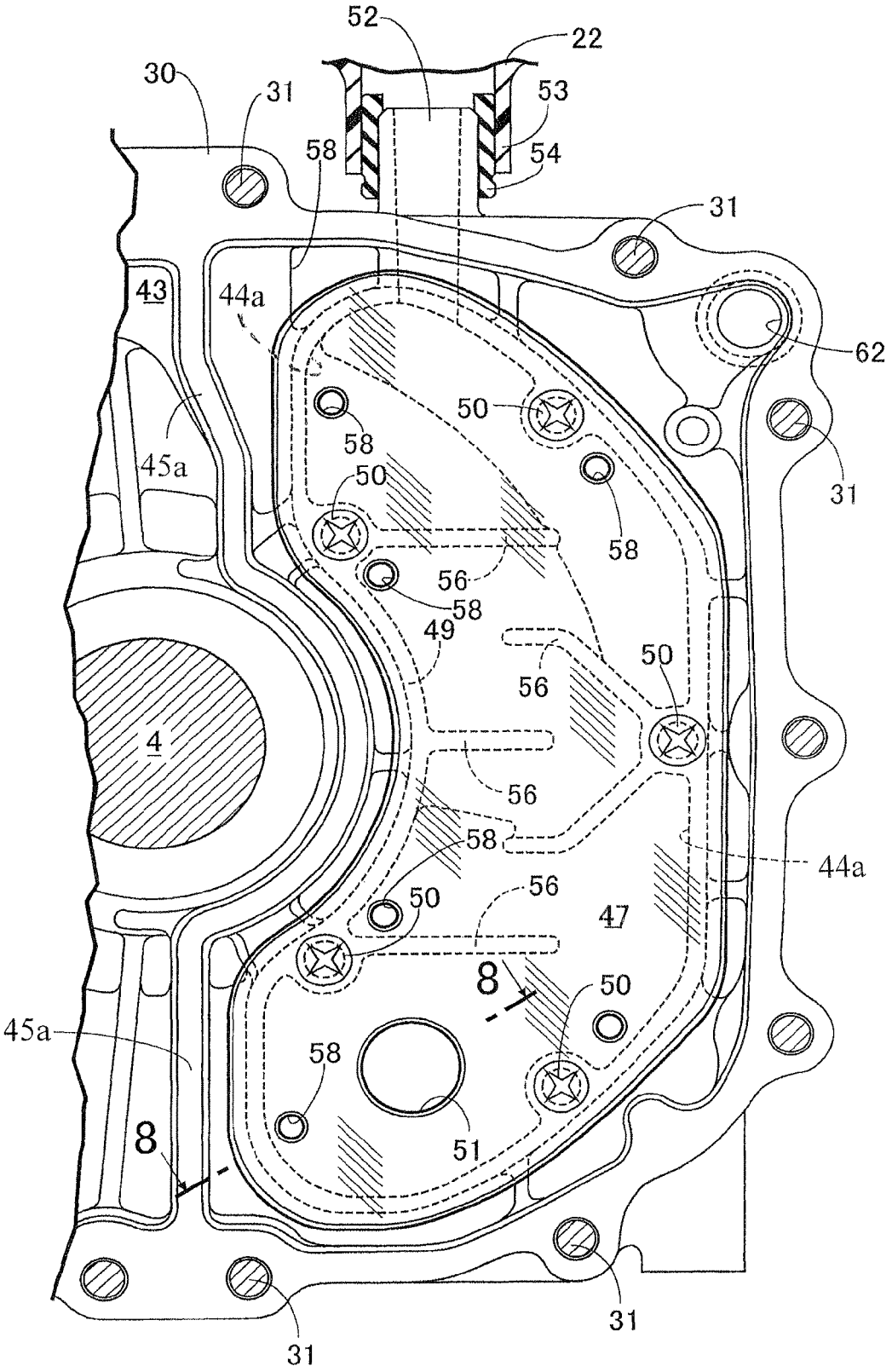
FIG. 6 is a sectional view taken along the line 6-6 in FIG. 4.
Figure 7:
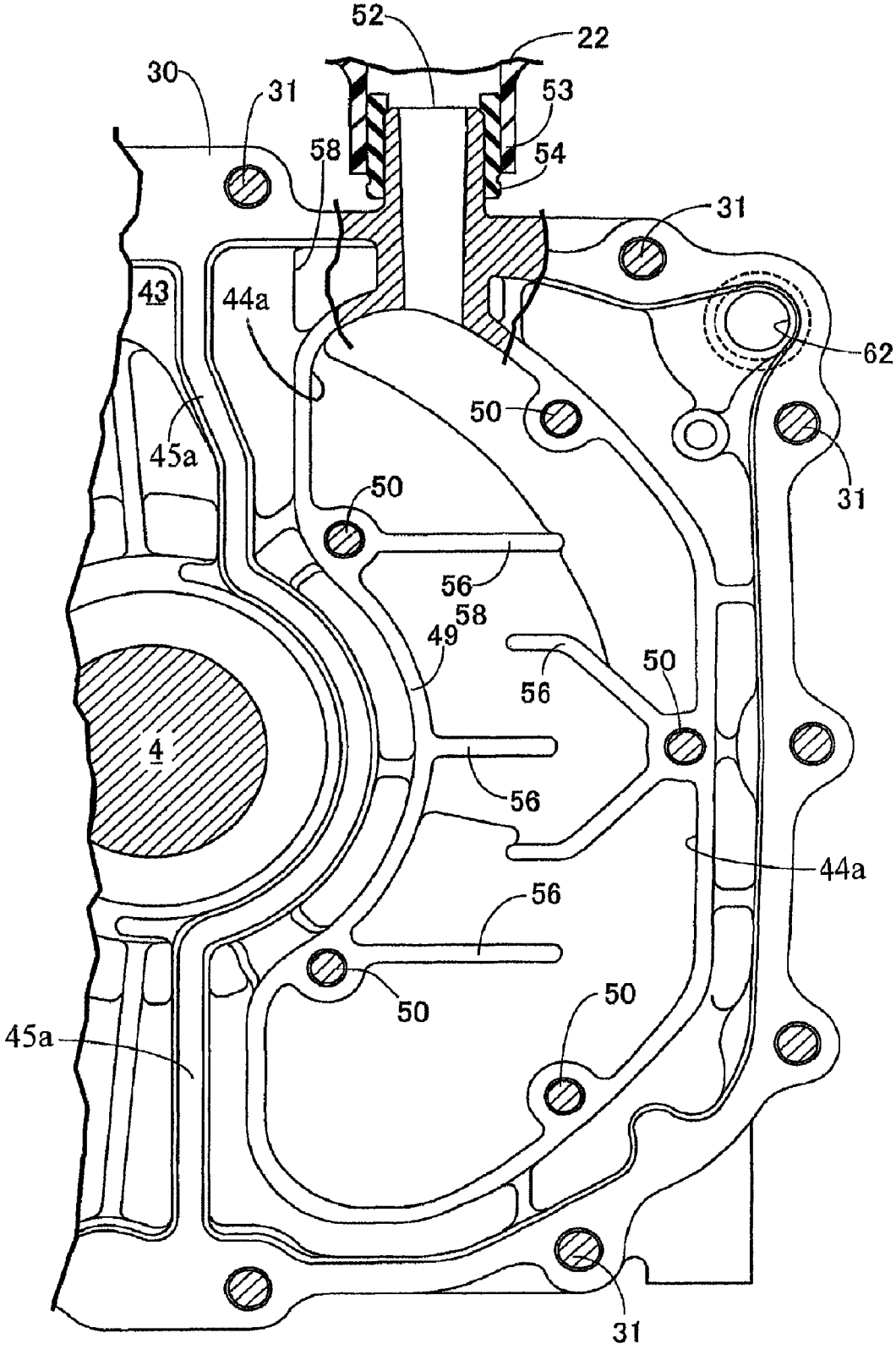
FIG. 7 is a view corresponding to FIG. 6 with a partition plate being removed.
Figure 8:
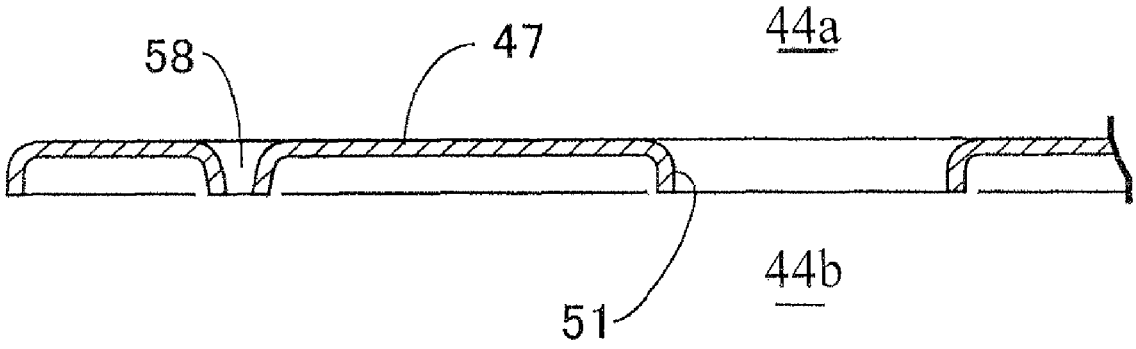
FIG. 8 is a sectional view taken along the line 8-8 in FIG. 6.

As shown in FIG. 6, lower oil return holes 57 that provide communication between the lower breather chamber 44*b* and the crank chamber 16 immediately below the lower breather chamber 44*b* and have a much smaller diameter than that of the communication hole 51 are provided at a plurality of corners on a bottom wall of the lower breather chamber 44*b*. Also as shown in FIGS. 6 and 8, upper oil return holes 58 that provide communication between the upper breather chamber 44*a* and the lower breather chamber 44*b* and similarly have a small diameter are provided at a plurality of corners on the partition plate 47. The upper oil return hole 58 is formed into a funnel shape so as to facilitate oil stored on the upper surface of the partition plate 47 flowing down to the lower breather chamber 44*b*. The lower oil return hole 57 and the upper oil return hole 58 are placed in positions offset from each other on plan view so that droplets of oil in the crank chamber 16 do not reach the upper oil return hole 58 even if swiftly passing through the lower oil return hole 57.

Next, an operation of the embodiment will be described.

When pressure in the crank chamber 16 changes with reciprocating motion of the piston 15 during operation of the engine E, breathing operations occur between the crank chamber 16 and the intake silencer box 22 upstream of the throttle body 20 through the through hole 17 in the uppermost journal support wall 12, the timing transmission chamber 43, the communication tube 60, the lower breather chamber 44*b*, the communication hole 51, the upper breather chamber 44*a* and the breather outlet pipe 52. During these operations, a blow-by gas generated in the crank chamber 16 is exhausted to the intake silencer box 22 together with the breathing gas, and taken in by the engine E together with intake air flowing in the intake silencer box 22. At the time of air intake in the crank chamber 16, fresh air in the intake silencer box 22 flows reversely through the above described path into the crank chamber 16.

The breathing gas in the crank chamber 16 is first exhausted through the through hole 17 to the timing transmission chamber 43 having large capacity, and pressure reduction caused by expansion of the breathing gas allows oil mist in the breathing gas to be liquefied and separated. Thus, the timing transmission chamber 43 serves as a pre-breather chamber.

In particular, the opening of the first connecting pipe 61 into the timing transmission chamber 43 is placed on the outside of the travel path of the timing chain 29, thereby preventing as much as possible droplets of lubricant oil dispersed from the timing chain 29 from entering the communication tube 60 side.

Next, every time the breathing gas including oil mist that cannot be completely separated in the timing transmission chamber 43 is exhausted to the lower breather chamber 44*b*, and from the lower breather chamber 44*b* through the communication hole 51 to the upper breather chamber 44*a*, pressure reduction caused by expansion of the breathing gas allows oil mist in the breathing gas to be liquefied and separated. In the lower breather chamber 44*b*, the breathing gas collides with the plurality of the lower labyrinth walls 55 and is turned its movement path when flowing from the communication tube 60 toward the communication hole 51. Thus, the oil mist adheres to the lower labyrinth walls 55 and is liquefied and separated from the breathing gas. Similarly, in the upper breather chamber 44*a*, the breathing gas collides with the plurality of the upper labyrinth walls 56 and is turned its movement path when flowing from the communication hole 51 toward the breather outlet pipe 52. Thus, the oil mist adheres to the upper labyrinth walls 56 and is liquefied and separated from the breathing gas.

In this manner, the oil separated from the breathing gas in the upper breather chamber 44*a* falls through the upper oil return hole 58 in the partition plate 47 to the lower breather chamber 44*b* side, and the oil separated from the breathing gas in the lower breather chamber 44*b* falls through the lower oil return hole 57 to the crank chamber 16 together with the oil having fallen through the upper oil return hole 58.

Thus, the timing transmission chamber 43 functions as a pre-breather chamber, and the timing transmission chamber 43 and the dedicated breather chamber 44 cooperate to generally and efficiently perform depressurization and separation of the oil from the breathing gas in the crank chamber 16.

Further, the timing transmission chamber 43 and the breather chamber 44 are connected via the communication tube 60, and thus placement flexibility of the breather chamber 44 is high. In particular, the communication tube 60 has flexibility, and thus can be freely placed without choosing a position of the breather chamber 44, thereby further increasing placement flexibility of the breather chamber 44. Further, communication between the timing transmission chamber 43 and the breather chamber 44 can be provided easily and inexpensively. Moreover, the oil mist is cooled by the communication tube 60 when passing through the communication tube 60, returns to the timing transmission chamber 43 or moves to the breather chamber 44 in a liquefied state, and is not discharged to the outside, thereby facilitating gas-liquid separation.

Further, in the breather chamber 44, the oil mist contained in the breathing gas can be efficiently separated from the breathing gas and returned to the crank chamber 16 by a two-step pressure reducing action and a long labyrinth action, thereby effectively preventing unnecessary discharge of the lubricant oil.

The breather chamber 44, dedicated for gas-liquid separation, having large capacity, and comprised of the upper and lower breather chambers 44*a* and 44*b* is placed in dead space between the crank case 9 and the generator 34 on the side opposite from the cam shaft 10 with respect to the crankshaft 4, thereby preventing an increase of the entire size of the engine E due to the breather chamber 44.

The timing transmission chamber 43 and the breather chamber 44 are defined between the engine body Eb and the cover member 30 joined to the upper surface of the engine body Eb by the bolts, and the bulkhead 45 between the timing transmission chamber 43 and the breather chamber 44 is integrally formed with one or both of the crank case 9 and the cover member 30. Thus, by simply joining the cover member 30 to the upper surface of the engine body Eb, the timing transmission chamber 43 and the breather chamber 44 can be easily formed between the cover member 30 and the upper surface of the engine body Eb, thereby simplifying a structure and increasing assembling properties.

Further, the rotor 36 of the generator 34 is secured to the outer end portion of the crankshaft 4 passing through the through hole 32 provided in the cover member 30, and the stator 35 that cooperates with the rotor 36 is mounted to the upper surface of the cover member 30. Thus, the cover member 30 has a broad upper surface wall extending from the timing transmission chamber 43 to the breather chamber 44, and hence the stator 35 can be easily mounted using the upper surface wall.

The present invention is not limited to the above described embodiment, and various changes in design may be made without departing from the gist of the invention. For example, the breather outlet pipe 52 may be connected to an intake system of the engine other than the intake silencer box 22, or made open to the atmosphere.

What is claimed is:

1. A breather device of a vertical type engine comprising:

an engine body having a crank chamber and a cylinder bore;

a timing transmission chamber provided above the engine body and housing a timing transmission device that connects between a crankshaft and a cam shaft which are vertically placed, respectively, the timing transmission chamber communicating at one side with the crank chamber and at the other side with an outside, wherein the breather device comprises a breather chamber communicating with the timing transmission chamber via a communication passage, the breather chamber communicating with the outside.

2. The breather device of a vertical type engine according to claim 1, wherein the timing transmission chamber and the breather chamber are defined between the engine body that supports the crankshaft and the cam shaft, and a cover member joined to the engine body so as to cover an upper surface of the engine body; and a bulkhead between the timing transmission chamber and the breather chamber is formed integrally with one or both of the engine body and the cover member.

3. The breather device of a vertical type engine according to claim 1, wherein an opening of the communication passage into the timing transmission chamber is placed in an area other than an operation area of the timing transmission device.

4. The breather device of a vertical type engine according to claim 1, wherein the communication passage is comprised of a flexible communication tube.

* * * * *